US005749106A

United States Patent [19]

Loyd et al.

[11] Patent Number: 5,749,106

[45] Date of Patent: May 12, 1998

[54] PORTABLE SPA WITH ACCESS STAIRWAY SET INTO INDENTATION WITHIN SIDE WALLS

[76] Inventors: Casey Loyd; Buzz Loyd, both of 4722 W. Mission Blvd., Ontario, Calif. 91762

[21] Appl. No.: 645,819

[22] Filed: May 14, 1996

[51] Int. Cl.[6] ..... A47K 3/00

[52] U.S. Cl. ..... 4/541.1; 4/555; 4/559; 4/584

[58] Field of Search ..... 4/541.1, 541.2, 4/541.3, 541.4, 541.5, 541.6, 545, 546, 548, 549, 559, 584, 506, 509, 496, 494, 557, 489, 493, 508, 555

[56] References Cited

U.S. PATENT DOCUMENTS 4,404,697 9/1983 Hatcher ..... 4/496
4,512,042 4/1985 Striegel et al. ..... 4/496

*Primary Examiner*—David J. Walczak
*Attorney, Agent, or Firm*—Denton L. Anderson; Sheldon & Mak

[57] ABSTRACT

A portable spa is provided wherein an external axis stairway is provided within an indentation in one of the sidewalls of the tub.

9 Claims, 2 Drawing Sheets

PORTABLE SPA WITH ACCESS STAIRWAY SET INTO INDENTATION WITHIN SIDE WALLS

FIELD OF THE INVENTION

This invention relates generally to portable spas and hot tubs, and particularly to elevated portable spas and hot tubs having an external access stairway.

BACKGROUND OF THE INVENTION

Portable spas and hot tubs have become enormously popular in the United States. One of the reasons for this popularity is that portable spas can be mass produced for economy of manufacture and installed at the consumer's residence at grade-level, without the necessity of costly excavation.

Portable spas mounted at grade level, however, present a problem of ingress and egress because the elevated walls of a typical portable spa are three to five feet in height. To grant easy ingress and egress from such portable spas, manufacturers have traditionally included an external stairway with the portable spas. Unfortunately, as presently constructed, the addition of an external stairway markedly increases the size of the required "footprint" of the portable spa. This is especially a problem where the spa is to be located indoors, within a relatively confined space.

Accordingly, there is a need for a portable spa having an external stairway for easy ingress and egress which does not increase the required footprint of the spa.

SUMMARY OF THE INVENTION

The portable spa of the invention satisfies this need.

The invention is a portable spa having a bottom wall and side walls. A portion of at least one of the sidewalls is inwardly indented to form a indentation. Within the indentation, at least one stair tread is disposed to facilitate ingress to and egress from the portable spa tub.

In a typical embodiment, the spa tub is enclosed with a skirt, and the stair tread or treads are set within a concomitant indentation in the spa skirt.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
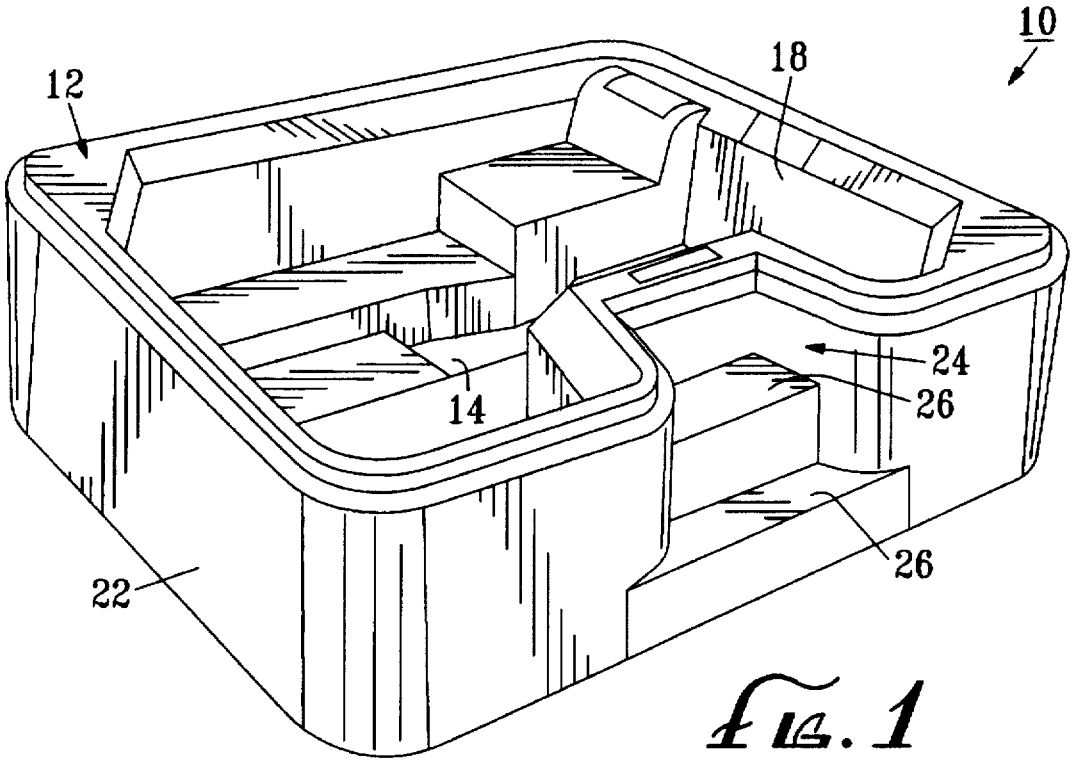
FIG. 1 is a perspective view of a portable spa having features of the invention.
Figure 2:
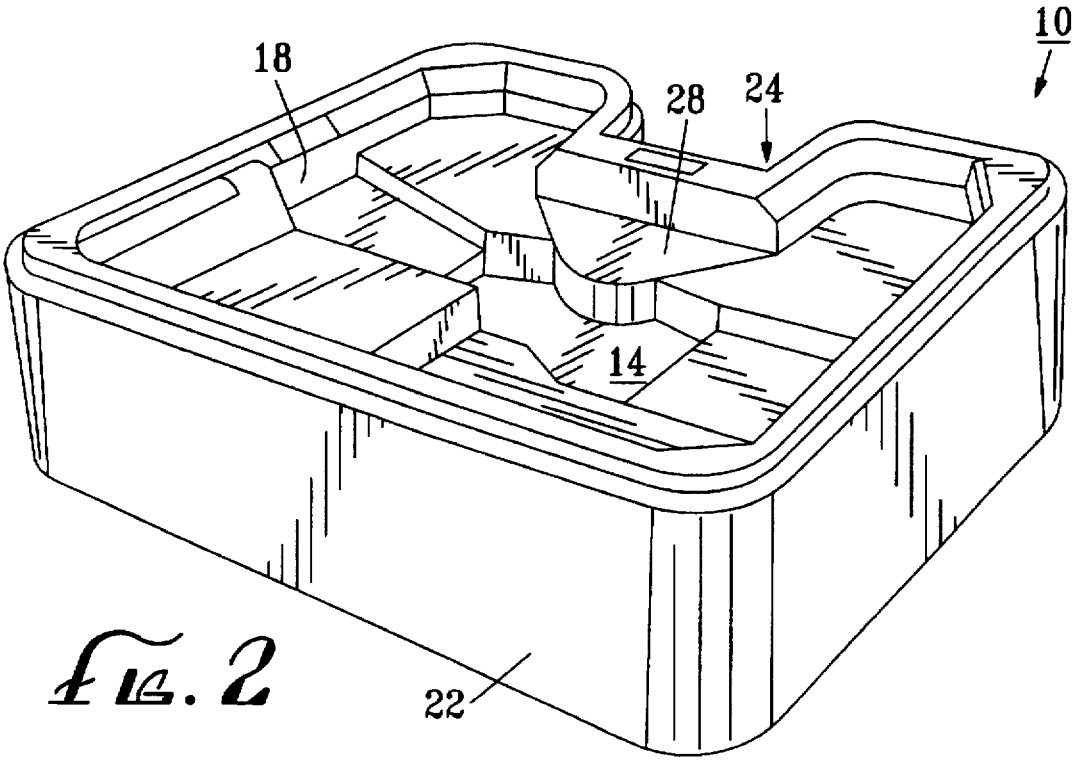
FIG. 2 is a second perspective view of the portable spa of FIG. 1.
Figure 3:
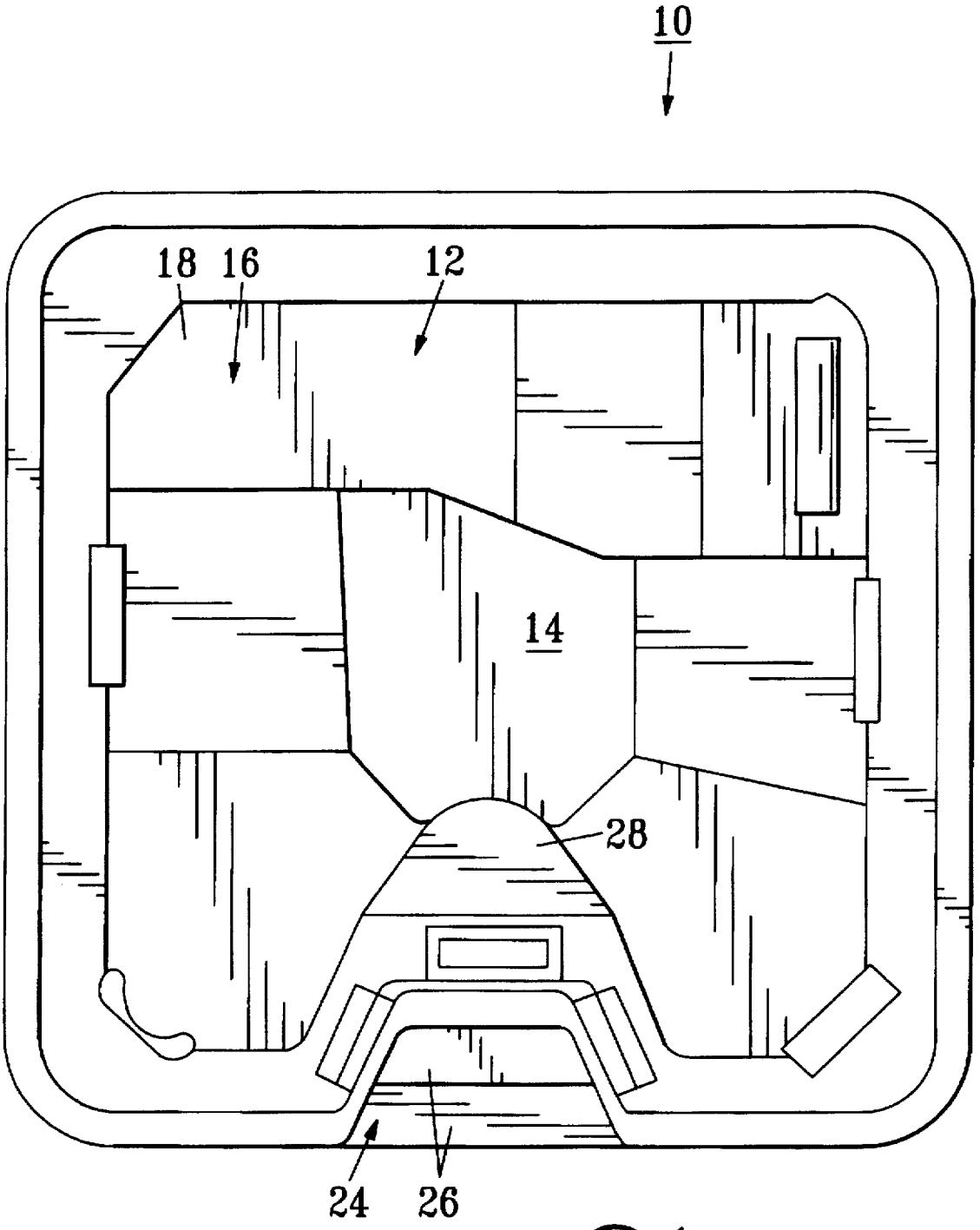
FIG. 3 is a top view of the portable spa of FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a portable spa 10 having a watertight spa tub enclosure 12 with a bottom wall 14 and side walls 16.

The side walls 16 have an interior surface 18 and an exterior surface. In a typical embodiment, the spa tub 12 is made from a plastic material, a fiberglass composite or wood. Most typically, the spa tub 12 is manufactured from a molded acrylic.

The side walls 16 can be generally linear or they can be outwardly arcuate. In one embodiment (not shown in the drawings), the side walls 16 are outwardly arcuate so that the perimeter of the spa tub 12 is generally circular. In the embodiment shown in the drawings, the side walls 16 of the spa tub 12 are generally linear and define a generally rectangular spa tub 12.

In a typical embodiment, the perimeter of the spa tub 12 is surrounded by a generally vertical skirt 22. In a typical embodiment, the skirt 22 is made from an attractive wood. Plastic, fabric or other materials can also be used.

A portion of at least one of the side walls 16 is inwardly indented to form an indentation 24. The indentation 24 is at least about 1 foot in length and about 1 foot in depth. Disposed within the indentation is at least one stair tread 26 to facilitate ingress to and egress from the spa 10. In a typical embodiment wherein the height of the spa tub 12 is 3 to 5 feet in height, 2 or 3 stair treads are disposed within the indentation 24. Typically, the height of each of the stair treads 26 is between about 6 inches and about 1 foot.

Preferably, the indentation 24 is of sufficient depth so that none of the stair treads 26 protrude outside the nominal perimeter of the spa tub 12, so as to not increase the required footprint of the spa 10.

In embodiments wherein the spa tub 12 is surrounded by a skirt 22, the skirt is comparably indented within the indentation 24 to facilitate installation of the stair treads 22.

In a typical embodiment, the interior surface 18 of the side walls 16 define one or more interior stair treads 28, generally disposed opposite the indentation 24. Such interior stair treads 26 facilitate ingress to and egress from the interior of the spa tub 12.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A portable spa comprising a watertight tub enclosure having a bottom and side walls, the side walls being generally linear or outwardly arcuate, wherein:

(a) a portion of at least one of the side walls is inwardly indented to form an indentation;

(b) the indented portion is at least one foot in length;

(c) the indented portion is at least one foot in depth; and (d) at least one stair tread is disposed within the indentation to facilitate ingress to and egress from the portable spa.

2. The portable spa of claim 1 wherein the bottom and side walls are molded.

3. The portable spa of claim 1 wherein the bottom and side walls are made from acrylic.

4. The portable spa of claim 1 wherein the side walls define a rectangle.

5. The portable spa of claim 1 wherein the indented side wall has an exterior surface and an interior surface, and wherein the interior surface defines at least one stair tread to facilitate ingress to and egress from the portable spa.

6. The portable spa of claim 1 wherein at least two stair treads are disposed within the indentation.

7. The portable spa of claim 1 wherein the side walls have an exterior surface and an interior surface and wherein a skirt is disposed around the exterior surface of the side walls, the skirt having an indentation corresponding to the indentation in the at least one of the side walls.

8. The portable spa of claim 7 wherein the skirt is made from wood.

9. A portable spa comprising a bottom and side walls, the side walls being generally linear or outwardly arcuate, wherein:

(a) the bottom and side walls are molded;

(b) a portion of at least one of the side walls is inwardly indented to form an indentation;

(c) the indented portion is at least one foot in length;

(d) the indented portion is at least one foot in depth;

(e) at least one stair tread is disposed within the indentation to facilitate ingress to and egress from the portable spa;

(f) the indented side wall has an exterior surface and an interior surface, and wherein the interior surface defines at least one stair tread to facilitate ingress to and egress from the portable spa; and (g) the side walls have an exterior surface and an interior surface and wherein a skirt is disposed around the exterior surface of the side walls, the skirt having an indentation corresponding to the indentation in the at least one of the side walls.

* * * * *